United States Patent [19]

Elmberg et al.

[11] 4,213,503

[45] Jul. 22, 1980

[54] SLOPE CONTROL SYSTEM

[75] Inventors: Dwayne R. Elmberg, Golden Valley; Royal R. Hawkins, Bloomington, both of Minn.

[73] Assignee: Honeywell Inc., Minneapolis, Minn.

[21] Appl. No.: 760,200

[22] Filed: Jan. 17, 1977

Related U.S. Application Data

[63] Continuation of Ser. No. 548,500, Feb. 10, 1975, abandoned.

[51] Int. Cl.[2] ..... E02F 3/76

[52] U.S. Cl. ..... 172/4.5

[58] Field of Search ..... 172/4.5; 404/84; 73/1 E, DIG. 3; 318/575, 578, 587, 625, 632

[56] References Cited

U.S. PATENT DOCUMENTS

| | | | |
|---|---|---|---|
| 2,941,319 | 6/1960 | Beemer et al. | 172/4.5 |
| 2,961,783 | 11/1960 | Bowen et al. | 172/4.5 |
| 3,026,638 | 3/1962 | Hayner et al. | 172/4.5 |
| 3,303,589 | 2/1967 | Rivinius | 172/4.5 |
| 3,791,452 | 2/1974 | Long et al. | 172/4.5 |

*Primary Examiner*—Richard T. Stouffer

*Attorney, Agent, or Firm*—Trevor B. Joike

[57] ABSTRACT

In a slope control apparatus for the working tool of a motor grader or other earth working machine, the slope sensor used for controlling the slope of the tool is mounted on a revolving platform the attitude of which is corrected by a factor related to the rotational angle of the tool about a vertical axis and also related to the angle of the tool with respect to the line of flight axis of the machine. The apparatus is mounted in a fashion to allow the tool to be swung to a vertical position without damage to said apparatus.

20 Claims, 5 Drawing Figures

SLOPE CONTROL SYSTEM

This is a continuation of application Ser. No. 548,500, filed Feb. 10, 1975, now abandoned.

BACKGROUND OF THE INVENTION

This invention is an improvement of that disclosed in U.S. application Ser. No. 408,778 filed Oct. 23, 1973, now abandoned. The present invention concerns the automatic control of the position of the working tool of an earth working machine and, according to the preferred embodiment, the position of the blade of the motor grader. More specifically, the present invention concerns the control of the transverse slope of the working tool or blade of an earth working machine. The preferred embodiment of the invention relates to the slope control of the blade of a motor grader although it is recognized that other types of machines may be controlled by the present invention.

In view of today's highway requirements, particularly high speed travel over modern highways, the demand for greater accuracy in preparing roadbeds for surfacing is substantial. At the same time, the grading operation must be accomplished quickly and efficiently in order to cope with the long distances over which our today's modern highways are to span. The present invention results in quick and efficient operation of a grading machine as well as a highly accurate grading operation by providing refinements in the automatic slope control system of the machine.

SUMMARY OF THE INVENTION

One such refinement results in a more accurately simulated slope of the motor grader blade. If the blade and blade circle arrangement of a grader are always maintained in a plane which is parallel to the line of flight of the machine, the rotation of the blade about an axis perpendicular to this plane will not affect the slope angle of the blade. But if this plane is not maintained parallel to the line of flight of the machine, the slope angle of the motor grader blade changes upon rotation of the blade support circle as is discussed in U.S. Pat. Nos. 3,229,391 and 2,961,783. It is necessary, therefore, to introduce a correction factor dependent upon the rotation of the blade circle into the control system in order to effectively control the blade at the desired slope angle.

This control is accomplished in the instant invention by providing for the slope sensor, which may take the form of a pendulum, a support platform assembly for correcting the attitude of the slope sensor dependent upon the angle of the blade circle plane with respect to the line of flight of the machine and the rotation of the blade about an axis perpendicular to this plane.

A characteristic of some machines is that the blade of a grader can be swung either to the right or left of the machine so that the blade assumes a vertical position alongside the machine. In the apparatus shown in the above mentioned patent application Ser. No. 408,778, such movement of the blade would result in damage to or destruction of the slope sensing structure. A further refinement of the instant invention is, therefore, an arrangement of the slope control system which will allow such movement of the blade without resulting in damage to or destruction of the slope sensing apparatus.

Other advantages of the present invention will be apparent from a review of the following specification, wherein a preferred form of the invention is described, by reference to the accompanying drawings.

SHORT DESCRIPTION OF THE DRAWINGS

DETAILED DESCRIPTION

Figure 1:
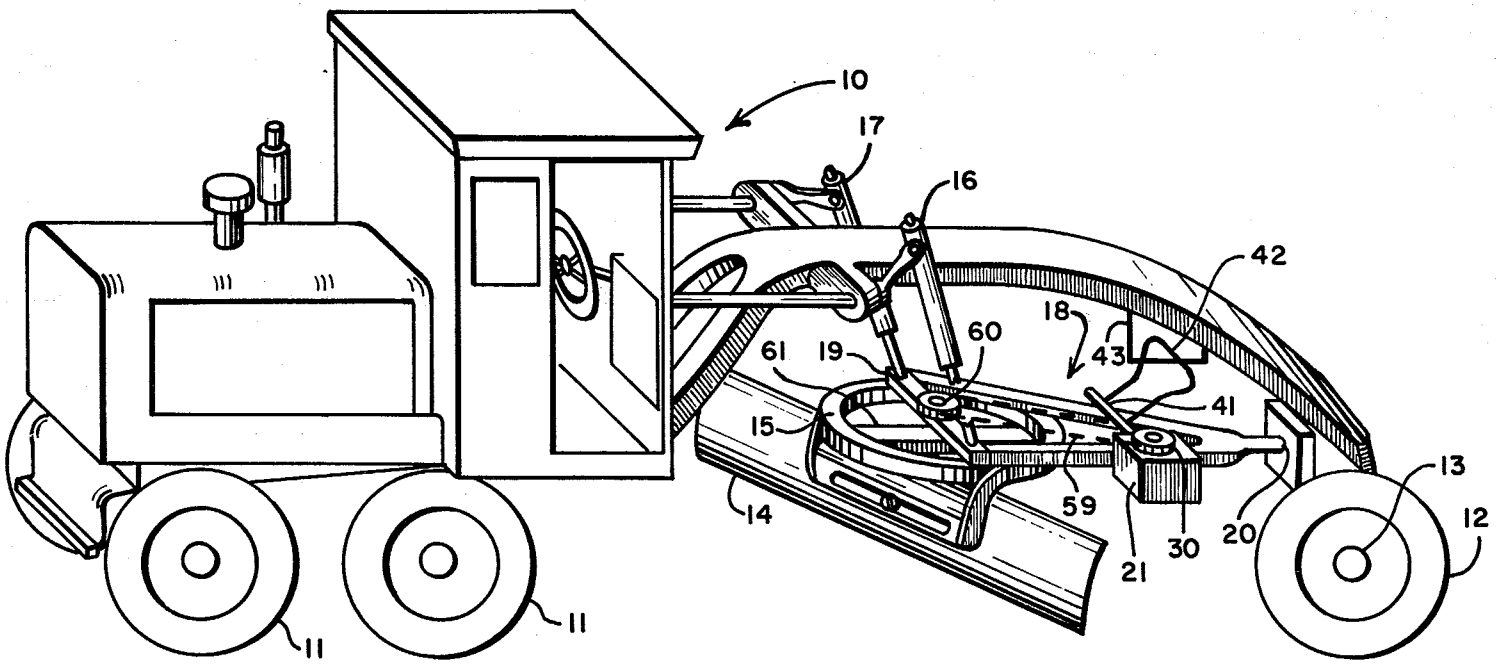
FIG. 1 is an illustration of the motor grader with the control system components mounted thereon.

In FIG. 1 there is shown a motor grader 10 having rear wheels 11 and front wheels 12. The front wheels 12 rotate about an axle 13 which is transversely pivotable around its connection to the front of the machine. The blade 14 of the machine is supported from a blade circle 15 the elevation of which is controlled by hydraulic rams 16 and 17 which also control the slope of the machine blade. The circle 15 is supported at the front of the machine by a drawbar assembly 18.

The drawbar assembly 18 comprises an A-frame having a cross-bar member 19 attached to the blade circle 15 by gears or other suitable means to allow for the rotation of the blade circle 15 with respect to cross-piece 19 and drawbar assembly 18. The drawbar assembly 18 is pivotally secured at 20 to the front of the machine frame and allows for both slope and grade adjustments of the blade. Hydraulic rams 16 and 17 are connected to respective ends of the cross-member 19. Hydraulic ram 16 has been broken away to show in detail the A-frame and circle assemblies. A control box 21 is securedly affixed, by suitable means not shown, to the drawbar assembly 18.

Figure 3:
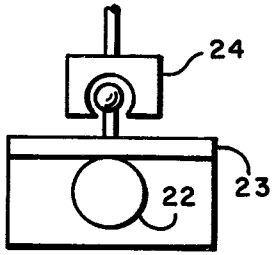
Figure 2:
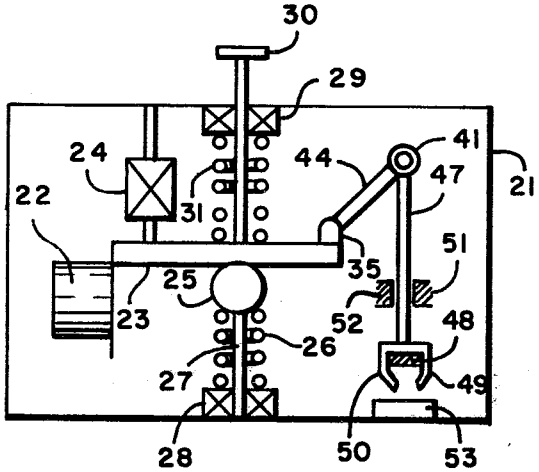
FIG. 2 is a side view of the slope control apparatus with in the housing 21 shown in FIG. 1.

A side view of the contents of control box 21 is shown in FIG. 2. A slope sensor 22 is supported from a platform 23 the rear of which is suspended from the top of the housing 21 by a ball and socket arrangement 24 which is shown in more detail in FIG. 3. A member 25 supports the platform 23 and is arranged for rotational as well as vertical movement. The support member 25 is in the form of a tapered cylinder as shown in FIGS. 2 and 4.

The support member 25 is biased against the platform 23 by a spring 26 which surrounds a shaft 27 and the shaft 27 is supported for rotation by a bearing 28 and a bearing 29. The shaft 27, which is connected to a gear 30, extends through bearing 29, through appropriate holes in the platform 23 and support member 25 to the bearing 28. The platform 23 is biased against the support member 25 by an additional spring 31.

Figure 4:
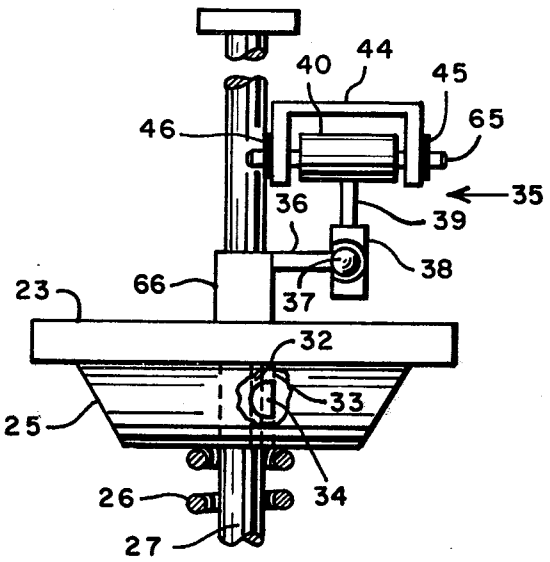
FIGS. 3–5 show various sub-assemblies of the slope control apparatus 21.

FIG. 4, which shows an enlarged frontal view of only a portion of the apparatus of FIG. 2 and in particular the manner in which the platform 23 is supported to be maintained parallel to the line of flight of the machine, shows in more detail how the support member 25 is supported on the shaft 27. The member 25 has a cylindrical opening to allow the shaft 27 to pass therethrough resulting in the support member 25 being slidably supported by the shaft 27 in cooperation with the spring 26. The shaft 27 has a slot 32 therein and the support member 25 has a slot 33 therein. A key 34 fits into both of the slots 32 and 33 to prevent any rotational movement of the support member 25 with respect to the shaft 27. The key 34 is help captive, by suitable means not shown, to the shaft 27.

In FIG. 2, radial arm 44 is attached to the front of the platform 23 by a joint 35 and joint 35 is shown in more detail in FIG. 4. A bracket 66, affixed to platform 23, has a pin 36 supporting a ball 37 in socket 38. The socket 38 is connected by an arm 39 to a member 40 which is fixedly secured to a shaft 65. As shown in FIG. 2, radial arm 44 is fixedly connected at its other end to shaft 41. As shown in FIG. 1, shaft 41 has a cam follower 42 thereon which follows a cam surface 43 fixed to the earth working machine. The radial arm 44 is rotatably supported on the shaft 65 and held in place by retaining clips 45 and 46.

In order to provide floating proportional positional control as described in U.S. Pat. No. 3,908,765, an arm 47 is frictionally driven by the shaft 41 and has mounted on the end thereof a magnet 48 with pole pieces 49 and 50. Limits 51 and 52 are provided in accordance with the teachings of the above mentioned application to limit the sweep of the arm 47. The magnet and pole piece assembly 48–50 is designed to cooperate with the Hall effect sensor 53 which provides a proportional electrical output signal dependent upon the position across its surface of the magnetic assembly supported at the end of arm 47.

Figure 5:
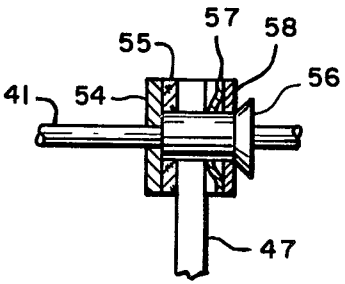

FIG. 5 shows how the arm 47 is frictionally driven by the rotation of shaft 41. The friction drive arrangement comprises a collar 54 which is fixedly secured to the shaft 41 and a cork disc 55 which is secured by suitable means between the collar 54 and the arm 47. The cork disc 55 and arm 47 fit over a flared sleeve 56 which is secured to the shaft 41. A wave spring 57 fits between the arm 47 and a collar 58 which is held in place by the flared end of sleeve 56. Because the cork disc is flexible, the rotation of shaft 41 will cause the rotation of the arm 47 until the arm 47 butts against a limit 51 or 52. At that time, the cork disc will flex and, although the shaft 41 may continue to rotate, the arm 47 will remain stationary against the limit.

The gear 30 shown in FIG. 1 has a chain 59 wrapped therearound and cooperates with a gear 60 rotatably supported on the cross-piece 19 of the drawbar frame 18. The gear 60 is rotated by a connection therefrom through member 19 to a member 61 fixedly secured upon the blade circle. Thus, as the blade circle is rotated, the gear 60 rotates which, through the chain 59, rotates the gear 30.

IN OPERATION

Assuming that the blade circle 15 and drawbar frame 18 are in a plane parallel to the line of flight of the machine, rotation of the blade circle 15 and blade 14 will not affect the slope angle of the blade 14. Furthermore, as the gear 30, in FIG. 2, rotates, support member 25 will also rotate. However, since the platform 23 is also parallel to the line of flight of the machine, the slope of the platform 23 will not be altered by rotation of the blade circle; and thus, the output signal from the slope sensor 22 will represent the true slope of the machine.

Assuming that the hydraulic rams 16 and 17 move the blade circle 15 and drawbar frame 18 to a position below this plane, the movement is sensed by the cam follower 42 and causes shaft 41 to rotate the radial arm 44 of FIG. 2 in a counterclock wise direction pushing down on the front of platform 23. This movement maintains the platform 23 parallel to the line of flight of the machine. However, the shaft 27 and support member 25 retain the same orientation with respect to the housing 21 that they had when the blade circle was parallel to the line of flight of its machine. Now if the blade circle assembly 15 is rotated, the gear 30 will rotate the support member 25 which will change the slope of the platform 23, and thus the sensor 22, by an amount dependent upon the amount of rotation of the blade circle 15.

If the hydraulic rams 16 and 17 operate the blade circle 15 to a position above this plane, the cam 42 and shaft 41 will sense this movement to rotate the radial arm 44 of FIG. 2 in a clock wise direction which will raise the front of the platform 23. The platform 23 is again maintained parallel to the line of fight of the machine and shaft 27 and member 25 remain in their fixed attitude with respect to housing 21. Therefore, any rotation of the gear 30 and member 25 will result in a change in the slope of the platform 23 and sensor 22 by an amount dependent upon the amount of rotation of the blade circle 15. Thus, the sensor 22 will sense the true slope of the blade.

Since the shaft 41 rotates by an amount dependent upon the movement of the drawbar frame 18 with respect to the machine 10, the movement of the arm 47 is also dependent upon movement of the drawbar frame 18 with respect to the machine 10 which control is disclosed in U.S. Pat. No. 3,908,765 above mentioned. Thus the output from the Hall effect sensor 53 can be used in the feedback circuit of a grade control system.

The embodiments of the invention in which an exclusive property or right is claimed are defined as follows:

1. A control apparatus for controlling the slope of an earth working tool of an earth working machine, said machine having means for adjusting the grade and slope of said tool, the tool having frame means for supporting said tool by said machine and for allowing rotation of said tool with respect to said frame means, said apparatus comprising:

housing means adapted to be fixedly secured to said frame means;

slope sensor means within said housing means for sensing the slope of said tool;

first means adapted to be responsive to rotation of said tool, about an axis substantially perpendicular to said frame means, and connected to said slope sensor means for providing a correction factor to said slope sensor means dependent upon the rotation of said tool; and, second means adapted to be responsive to deviations of said tool from an axis parallel to the line of flight of said machine and connected to said slope sensor means for maintaining said slope sensor means substantially parallel to the line of flight of said machine, whereby said apparatus is arranged to allow for substantially 90° rotation of said tool about the longitudinal axis of the machine without damage to said apparatus.

2. The control apparatus of claim 1 wherein said slope sensor means include a support means and a slope sensor mounted on said support means.

3. The control apparatus of claim 2 wherein said second means comprises a cam surface adapted to be mounted on said machine and a cam follower responsive to said cam surface to sense the deviation between said frame and said machine for maintaining said support means parallel to the line of flight of the machine.

4. The control apparatus of claim 2 wherein said support means comprises a platform and wherein said first means comprises a member for supporting said platform, said member adapted to be rotated in accordance with rotation of said tool about said substantially perpendicular axis.

5. The control apparatus of claim 4 wherein said second means comprises a cam surface adapted to be mounted on said machine and a cam follower responsive to said cam surface to sense the deviation between said frame and said machine for maintaining said platform parallel to the line of flight of the machine.

6. The control apparatus of claim 5 wherein said member is vertically moveable.

7. The control apparatus of claim 6 further comprising position proportional sensor means for providing a signal dependent upon the position of said slope sensor means with respect to said machine, said position proportional sensor means comprising an arm, a friction drive coupled between said cam follower and said arm, a proportional sensor responsive to the position of said arm, and limit stops for limiting the travel of said arm.

8. The control apparatus of claim 7 wherein said proportional sensor means comprises a magnetic structure mounted on said arm and a Hall effect sensor responsive to said magnetic structure.

9. The control apparatus of claim 1 further comprising position proportional sensor means for providing a signal dependent upon the position of said slope sensor means with respect to said machine, said position proportional sensor means comprising an arm, a friction drive coupled between said second means and said arm, a proportional sensor responsive to the position of said arm, and limit stops for limiting the travel of said arm.

10. The control apparatus of claim 9 wherein proportional sensor means comprises a magnetic structure mounted on said arm and a Hall effect sensor responsive to said magnetic structure.

11. A control apparatus for controlling the slope of an earth working tool of an earth working machine, said machine having means for adjusting the grade and slope of said tool, said tool having frame means for supporting said tool by said machine and for allowing rotation of said tool with respect to said frame means, said apparatus comprising:

housing means fixedly secured to said frame means; slope sensor means within said housing means for sensing the slope of said tool;

first means responsive to rotation of said tool, about an axis substantially perpendicular to said frame means, and connected to said slope sensor means for providing a correction factor to said slope sensor means dependent upon the rotation of said tool; and, second means responsive to deviations of said tool from an axis parallel to the line of flight of said machine and connected to said slope sensor means for maintaining said slope sensor means substantially parallel to the line of flight of said machine, whereby said apparatus is arranged to allow for substantially 90° rotation of said tool about the longitudinal axis of the machine without damage to said apparatus.

12. The control apparatus of claim 11 wherein said slope sensor means includes a support means and a slope sensor mounted on said support means.

13. The control apparatus of claim 12 wherein said second means comprises a cam surface mounted on said machine and a cam follower responsive to said cam surface to sense the deviation between said frame and said machine for maintaining said support means parallel to the line of flight of the machine.

14. The control apparatus of claim 12 wherein said support means comprises a platform and wherein said first means comprises a member for supporting said platform, said member connected to be rotated in accordance with rotation of said tool about said substantially perpendicular axis.

15. The control apparatus of claim 14 wherein said second means comprises a cam surface mounted on said machine and a cam follower responsive to said cam surface to sense the deviation between said frame and said machine for maintaining said platform substantially parallel to the line of flight of the machine.

16. The control apparatus of claim 15 wherein said member is vertically movable.

17. The control apparatus of claim 16 further comprising position proportional sensor means for providing a signal dependent upon the position of said slope sensor means with respect to said machine, said position proportional sensor means comprising an arm, a friction drive coupled between said cam follower and said arm a proportional sensor responsive to the position of said arm, and limit stops for limiting the travel of said arm.

18. The control apparatus of claim 17 wherein said proportional sensor means comprises a magnetic structure mounted on said arm and a Hall effect sensor responsive to said magnetic structure.

19. The control apparatus of claim 11 further comprising position proportional sensor means for providing a signal dependent upon the position of said slope sensor means with respect to said machine, said position proportional sensor means comprising an arm, a friction drive coupled between said second means and said arm, a proportional sensor responsive to the position of said arm, and limit stops for limiting the travel of said arm.

20. The control apparatus of claim 19 wherein proportional sensor means comprises a magnetic structure mounted on said arm and a Hall effect sensor responsive to said magnetic structure.

* * * * *